US007114716B2

(12) United States Patent
Otsuka et al.

(10) Patent No.: US 7,114,716 B2
(45) Date of Patent: Oct. 3, 2006

(54) PAPER FEEDER

(75) Inventors: Kazuo Otsuka, Nagano (JP); Masafumi Furuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/671,556

(22) Filed: Sep. 29, 2003

(65) Prior Publication Data

US 2004/0061279 A1 Apr. 1, 2004

Related U.S. Application Data

(63) Continuation of application No. 09/866,868, filed on May 30, 2001, now Pat. No. 6,708,969.

(30) Foreign Application Priority Data

May 31, 2000 (JP) ..... P.2000-161447

(51) Int. Cl.
*B65H 3/52* (2006.01)

(52) U.S. Cl. ..... 271/121

(58) Field of Classification Search ..... 271/121, 271/126, 127, 162, 164, 149, 167
See application file for complete search history.

(56) References Cited

U.S. PATENT DOCUMENTS 3,883,241 A * 5/1975 Zeuthen ..... 399/363
5,316,285 A 5/1994 Olson et al.
5,372,359 A 12/1994 Miura et al.
5,615,874 A * 4/1997 Parthasarathy et al. ..... 271/121
5,655,762 A * 8/1997 Yergenson ..... 271/121
5,725,208 A * 3/1998 Miyauchi ..... 271/10.09
5,769,411 A * 6/1998 Nakagawa et al. ..... 271/122
5,882,004 A * 3/1999 Padget ..... 271/119
5,997,198 A * 12/1999 Murayama et al. ..... 400/624
6,059,281 A * 5/2000 Nakamura et al. ..... 271/119
6,082,729 A * 7/2000 Padget ..... 271/121
6,126,161 A * 10/2000 Kato ..... 271/121
6,199,855 B1 3/2001 Choeng et al.
6,217,017 B1 4/2001 Yamazaki
6,382,621 B1 5/2002 Inoue et al.
6,491,295 B1 * 12/2002 Otsuka et al. ..... 271/118

(Continued)

FOREIGN PATENT DOCUMENTS

JP 55-044473 3/1980

(Continued)

*Primary Examiner*—Kathy Matecki
*Assistant Examiner*—Matthew J. Kohner
(74) *Attorney, Agent, or Firm*—Sughrue Mion, PLLC

(57) ABSTRACT

A paper returner is placed in the vicinity of an end portion of a hopper for stacking a plurality of sheets of paper which faces a paper feeding roller, so as to be pivotable between a first position where the paper returner constitutes a part of the paper transporting passage, and a second position where the paper returner is isolated from the paper transporting passage. A separation pad is provided on a first face of the paper returner. The separation pad has a friction coefficient which is higher than a friction coefficient of the first face of the paper returner. The paper returner is placed at the first position so that a top sheet of paper in the hopper is abutted against the paper feeding roller, and is separated from other sheets of paper by the separation pad. The paper returner is placed at the second position so that the first face of the paper returner returns sheets of paper, which are entered in the paper transporting passage-together with the sheet of paper to be fed, to the hopper.

7 Claims, 14 Drawing Sheets

U.S. PATENT DOCUMENTS 6,565,078 B1 * 5/2003 Foglino et al. ..... 271/124
6,609,707 B1 * 8/2003 Yano ..... 271/10.05
6,626,595 B1 * 9/2003 Kabamoto ..... 400/624
6,663,098 B1 * 12/2003 Teo et al. ..... 271/121
6,824,132 B1 * 11/2004 Asai et al. ..... 271/125
6,877,738 B1 * 4/2005 Sonoda et al. ..... 271/121
6,978,113 B1 * 12/2005 Kamimura et al. ..... 399/388
2004/0251592 A1 * 12/2004 Ruhe et al. ..... 271/109

FOREIGN PATENT DOCUMENTS

JP 10-181911 7/1998
JP 11-071036 3/1999
JP 2000-095354 4/2000

* cited by examiner

PAPER FEEDER

This is a continuation of application Ser. No. 09/866,868 filed May 30, 2001, now U.S. Pat. No. 6,708,969; the disclosure of which is incorporated herein by reference.

BACKGROUND OF THE INVENTION

This invention relates to a paper feeder used with a recording apparatus such as a printer for feeding sheet-like paper stacked on a hopper, and in particular to a paper feeder comprising a paper returner for returning an overlappedly transported sheet of paper to the hopper, the paper returner having a function of separating and feeding sheets of paper one by one.

A paper feeder used with a recording apparatus comprises two paper feeding rollers placed in a paper width direction, the one paper feeding roller being fixedly placed on one side edge side, and the other being built in an edge guide and semi-fixedly placed movably matching the paper width. A base end of the hopper is attached rotatably to a shaft at a right angle to the entry direction such that the whole of paper in the width direction is moved up or down at the same time by a cam mechanism associated with rotation of the paper feeding roller. A rotatable separation pad holder is provided with a separation pad to separate the sheets one by one from the hopper and feed each sheet.

When paper is abutted against the paper feeding roller, and at the same time, the separation pad is pressed against the paper feeding roller as the hopper moves up, the top sheet of paper is separated and fed. When the sheet arrives at a transport roller and skew removal is terminated, the paper feeding roller is rotated and stopped at a home position. Meanwhile, positioning is performed such that a distance between a leading edge of the paper sheet and a recording head is made constant is performed, and then print is started. When the paper feeding roller is stopped at the home position, a gap is formed between the paper feeding roller and the separation pad, but a part of the sheet being printed exists. At this time, another sheet overlappedly sent enters the gap, and two or more overlapped sheets may also be fed in conjunction with the sheet being printed in some cases. As a measure against such trouble, an idle roller is usually pressed against the separation pad. When a sheet being printed exists between the paper feeding roller and the separation pad, it is pressed against the separation pad by the idle roller, whereby entry of the sheets overlappedly sent is prevented. Each sheet whose entry is blocked is pushed and returned to the hopper by operating a paper return lever (paper returner) after the print terminates.

This related paper feeder comprises the separation pad holder and the paper return lever as separate components, and thus has a complicated structure and a large number of parts, leading to an increase in costs. Since the paper returning operation is performed after print, the next paper feed operation cannot be started until the paper returning operation terminates, and thus the time interval between the print termination of one sheet and the print start of another sheet (throughput) is prolonged. Further, since the sheet being printed is pressed against the idle roller, a contact load with the sheet occurs and leads to a load of a motor drive system, etc.

SUMMARY OF THE INVENTION

It is therefore an object of the invention to provide a paper feeder comprising a paper returner provided with a function of surely separating and feeding sheets of paper one by one.

It is another object of the invention to provide a paper feeder capable of performing the paper returning operation during printing.

In order to achieve the above objects, according to the present invention, there is provided a paper feeder, for feeding a sheet of paper to a recording apparatus, comprising:

a hopper, for stacking a plurality of sheets of paper;

a paper feeding roller, which constitutes a part of a paper transporting passage;

a paper returner, placed in the vicinity of an end portion of the hopper which faces the paper feeding roller, so as to be pivotable between a first position where the paper returner constitutes a part of the paper transporting passage, and a second position where the paper returner is isolated from the paper transporting passage; and a separation pad, provided on a first face of the paper returner, the separation pad having a friction coefficient which is higher than a friction coefficient of the first face of the paper returner, wherein the paper returner is placed at the first position so that a top sheet of paper in the hopper is abutted against the paper feeding roller, and is separated from other sheets of paper by the separation pad; and wherein the paper returner is placed at the second position so that the first face of the paper returner returns sheets of paper, which are entered in the paper transporting passage together with the sheet of paper to be fed, to the hopper.

In this configuration, since the separation pad is attached to the paper returner, so that the number of parts can be decreased and the structure can be simplified for reducing costs as compared with the case where the separation pad holder and the paper return lever are provided separately as in the related paper feeder.

Preferably, the paper feeder further comprises an auxiliary roller. Here, the paper feeding roller and the auxiliary roller are arranged in a widthwise direction of the sheet of paper. The first face of the returner abuts the top sheet of paper are abutted against the paper feeding roller and the auxiliary roller, when the paper returner is placed in the first position.

In this configuration, motion of the opposite end of paper with no caught entry by the paper feeding roller is suppressed and skew is hard to occur and can be prevented from causing a paper jam to occur.

Preferably, the first face of the returner prevents the sheets of paper in the hopper from entering the paper transporting passage, when the paper returner is placed in the second position.

In this configuration, when paper is not fed, the leading end of paper is regulated, and accidental entry of paper into the paper transporting passage can be blocked.

Preferably, the paper feeder further comprises an urging member, which urges the paper returner toward the second position. Here, the paper feeding roller includes a first portion which urges the first face of the paper returner toward the first position, against an urging force of the urging member.

In this configuration, the first face of the paper returner is always abutted against the paper feeding roller, and paper pressing and paper returning operations of the paper returner are made reliable.

Here, it is preferable that the paper feeder further comprises an incliner, which inclines the paper returner from the second position toward the first position at a predetermined angle, so that the first face of the paper returner is urged by the first portion of the paper feeding roller.

In this configuration, the paper returner can be rotated smoothly without straining and the paper transporting passage from the hopper to the paper feeding roller is almost closed by the paper returner, so that accidental entry of paper into the paper transporting passage can be blocked.

Here, it is preferable that the incliner is placed outer than a widthwise end of the paper transporting passage.

In this configuration, if the incliner operates with jammed paper existing on the paper returner, the paper is not damaged.

Here, it is preferable that the incliner includes a cam cooperated with the paper feeding roller, and a cam follower formed on a part of the paper returner which is projected to the outside of the widthwise end of the paper transporting passage.

In this configuration, the incliner is implemented as the cam mechanism, so that the structure is simplified.

Preferably, the paper feeder further comprises a cam mechanism, which approaches the hopper to the paper feeding roller after the paper returner is placed in the first position.

If the approaching of the hopper to insert the sheet of paper is started while the paper returner is pivoting, there is probability that the leading end of paper is broken by the paper returner. However, in this configuration, the above-mentioned disadvantage can be prevented reliably.

Here, it is preferable that the paper returner starts to move to the second position after the cam mechanism separates the hopper from the paper feeding roller and before the feeding operation of the top sheet of paper is completed.

In this configuration, a sheet of paper transported together with the fed sheet can be returned to the hopper reliably. The operation is performed while paper is being fed, so that throughput is enhanced. Since the paper returner is at the second position during printing, an idle roller for blocking entry of extra paper into the paper transporting passage as in the related paper feeder becomes unnecessary, and the contact load between the paper returner and the paper feeding roller can be decreased.

Preferably, the paper feeding roller is placed in the vicinity of one widthwise end of the paper transporting passage. The hopper is pivotable about one widthwise end portion thereof which is in the vicinity of the other widthwise end of the paper transporting passage.

In this configuration, the longitudinal width of the hopper can be lessened for miniaturizing the hopper, and the number of parts can be reduced because only the paper feeding roller is required.

Preferably, a stacking plane of the hopper is parallel with a tangent plane of the paper feeding roller.

In this configuration, the entry angle into the separation pad does not change and paper is fed stably, even if the number of sheets of paper changes.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
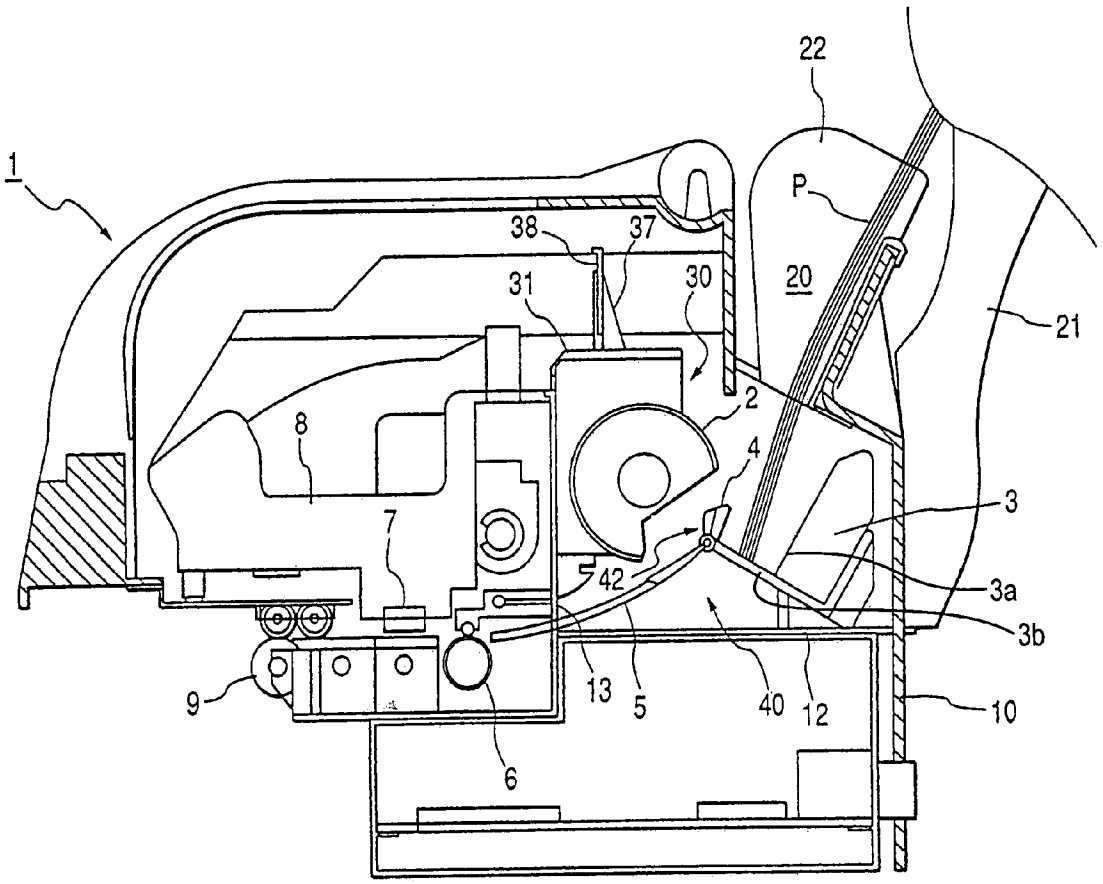
FIG. 1 is a transverse sectional view of a recording apparatus incorporating a paper feeder according to the invention.

Referring now to the accompanying drawings, there are shown preferred embodiments of the invention. FIG. 1 is a transverse sectional view of a recording apparatus incorporating a paper feeder according to the invention.

In a recording apparatus 1, a separation pad 4 is abutted against a rotating paper feeding roller 2 to separate one sheet of paper from a plurality of sheets of paper P stacked on a hopper 3, where the hopper has a first portion 3*a* that supports the plurality of sheets of paper P in a stacking direction of the sheets, and a second portion 3*b* that supports the plurality of sheets of paper P in a non-stacking direction of the sheets. The separated sheet is fed to a transport roller 6 along a paper guide 5, and a skew is removed, then the sheet is sent to a record area matching the print timing. Printing is performed by reciprocating a recording head 7 mounted on a carriage 8 in a subscanning direction of the sheet. Then the sheet is discharged by a discharge roller 9.

A paper support 21 is attached to a housing 10 of the recording apparatus 1 and an edge guide 22 for regulating the side margin of the paper P supported on the paper support 21 is slidably placed in the housing 10. The hopper 3 is rotatably placed between the edge guide 22 and the paper feeding roller 2, and when the hopper 3 is moved up, the separation pad 4 presses the top sheet of paper against the paper feeding roller 2 and separates and feeds the sheet.

A paper feeder 20 includes a first unit 30 comprising the paper feeding roller 2, an auxiliary roller 33, a transmission gear 35, etc., built in one piece, and a second unit 40 comprising the hopper 3 and a paper returner 42 having the separation pad 4, built in a frame 41 in one piece. The first unit 30 is fixed to the rear of a frame 13 partitioning the carriage 8, and the second unit 40 is attached to a main frame 12 so that the bottom portion of the frame 41 shaped like a mountain in cross section is roughly on an extension of a paper transporting passage connecting the transport roller 6 and the discharge roller 9. The units make it possible to reduce the number of assembling steps into the recording apparatus and lessen adjustment of the post-assembled units.

The first and second units will be discussed in more detail.

Figure 2:
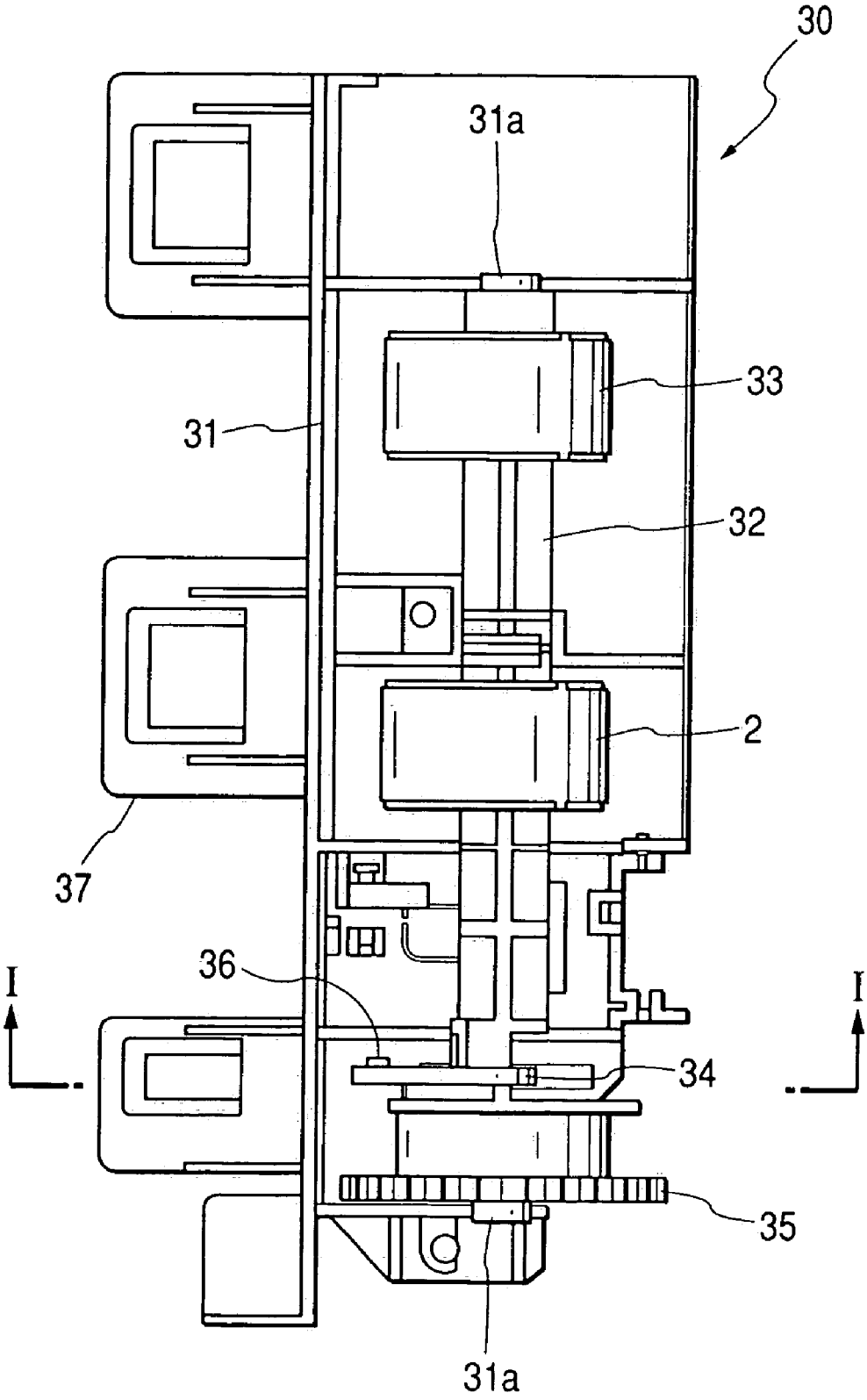
FIG. 2 is a plan view of a first unit.

In FIG. 2, the first unit 30 comprises a roller shaft 32 supported on a bearing part 31*a* of a roller holder 30 for rotation, and the paper feeding roller 2 and the auxiliary roller 33 are placed on the roller shaft 32. A hopper driving cam 34 forming a cam mechanism for moving up or down the hopper 3, and the transmission gear 35 are placed on the roller shaft 32. A subsidiary cam 36 for performing the initial inclining operation of the paper returner described later is placed on a side of the hopper driving cam 34. The transmission gear 35 is associated with a drive gear of a paper feed motor (not shown) via: an intermediate transmission gear.

Figure 3:
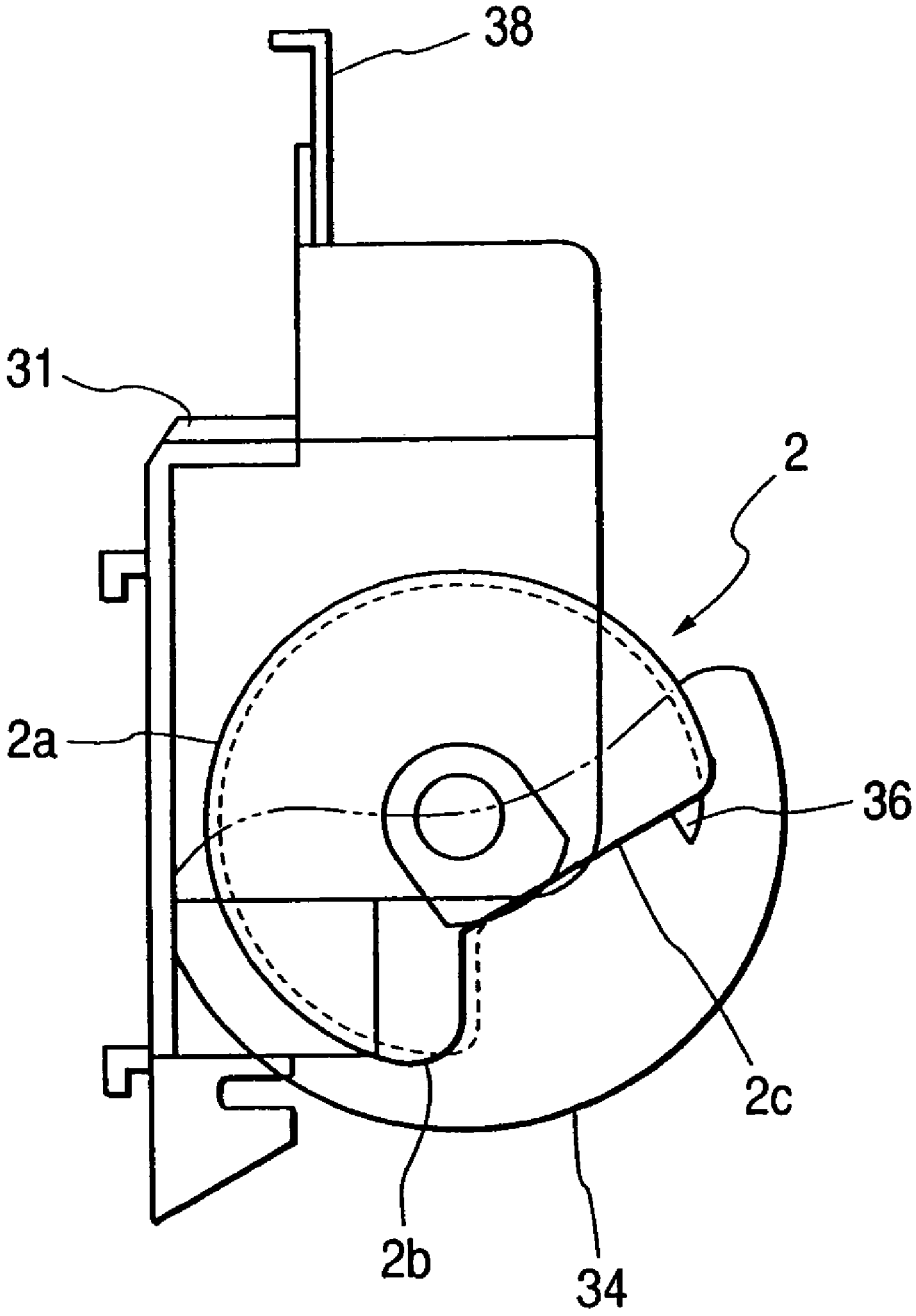
FIG. 3 is a side view of I—I arrow view in FIG. 2.

The paper feeding roller 2 consists of a round portion 2*a* and a flat portion 2*c*, as shown in FIG. 3, and a friction member is attached to the round portion 2*a* for feeding paper. The round portion 2*a* is extended to a protruded portion 2*b* for enlarging the circumferential for the paper feeding. The protruded portion 2*b* acts so as to reliably feed paper to the transport roller 6, if the paper load capacity of the hopper 3 changes. If one sheet of paper exists in the hopper 3, the time required to move up the hopper 3 from the lowermost position to abut the sheet of paper against the paper feeding roller 2 becomes the longest. That is, the paper feeding roller 2 rotates at a predetermined angle until the sheet of paper is abutted against the paper feeding roller 2, and thus the length of the protruded portion 2*b* is set so that paper arrives at the transport roller 6 as it is fed from the abutment position. Since the protruded portion 2*b* is provided, the circumferential length used for the paper feeding is extended without enlarging the diameter of the paper feeding roller 2, thereby the apparatus can be miniaturized.

To feed paper stored in the hopper 3 by one paper feeding roller 2 placed on one side in the paper width direction, one side of paper is caught in the paper feeding roller 2 and the paper side part is curled and enters the paper transporting passage. Since the paper feeding roller 2 does not exist on an opposite side of the paper, the paper enters the paper transporting passage straight. If paper is thus transported based on different entries in the paper width direction, skew occurs, easily causing a paper jam to occur. To solve the problem caused by the system wherein the paper feeding roller 2 is placed only on one side in the paper width direction, the auxiliary roller 33 is disposed to the center in the width direction away from the paper feeding roller 2.

Figure 10:
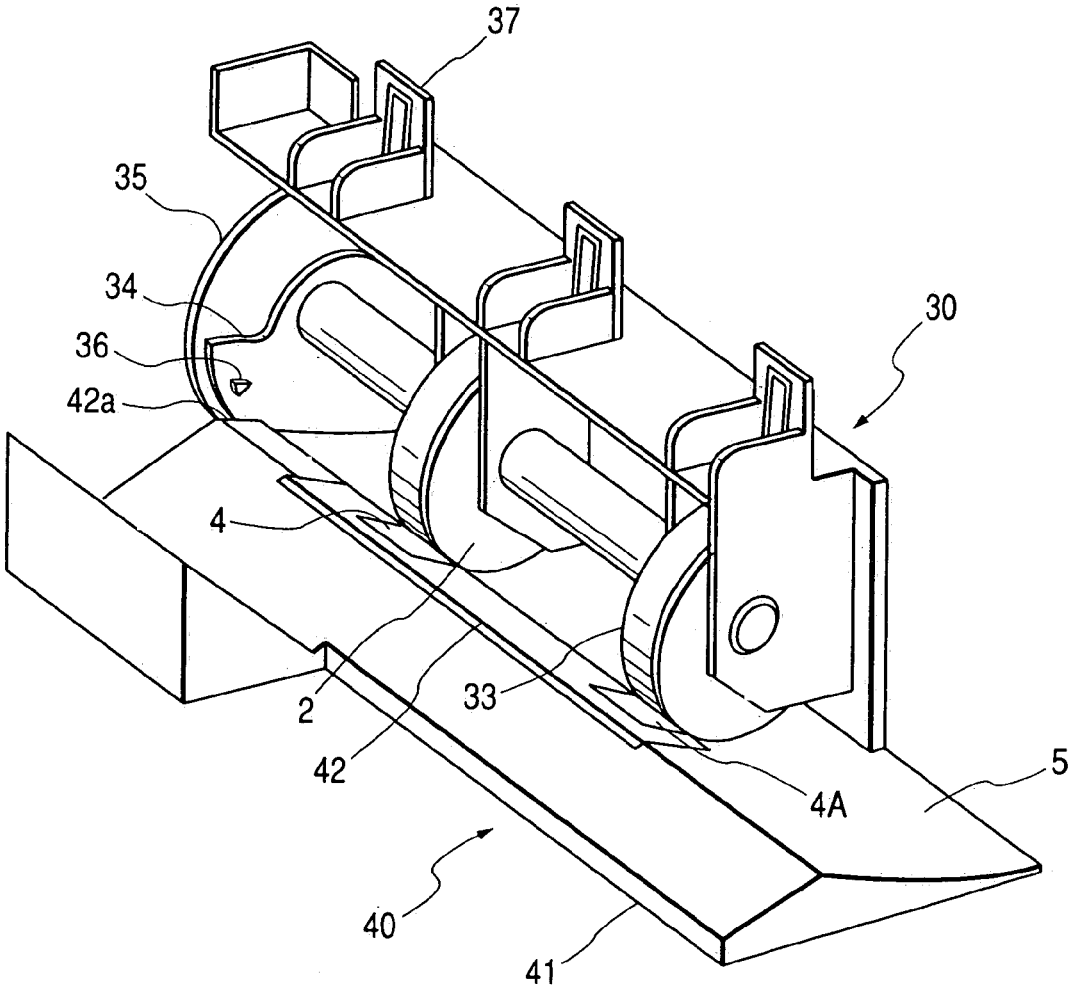
FIG. 10 is a perspective view when the first and second units are assembled.

As shown in FIG. 10, the auxiliary roller 33 is placed on the same axis as the paper feeding roller 2 and acts so as to catch a part of paper near the widthwise center like the paper feeding roller, which is pressed by an auxiliary pad 4A of the paper returner 42. Accordingly, undesired motion of the opposite end of paper is suppressed, and skew is hard to occur. Numeral 37 denotes a flat cable retainer placed in the frame 31 to retain a flat cable 38 for transmitting a print signal to the recording head 7 (see FIG. 1).

Figure 4:
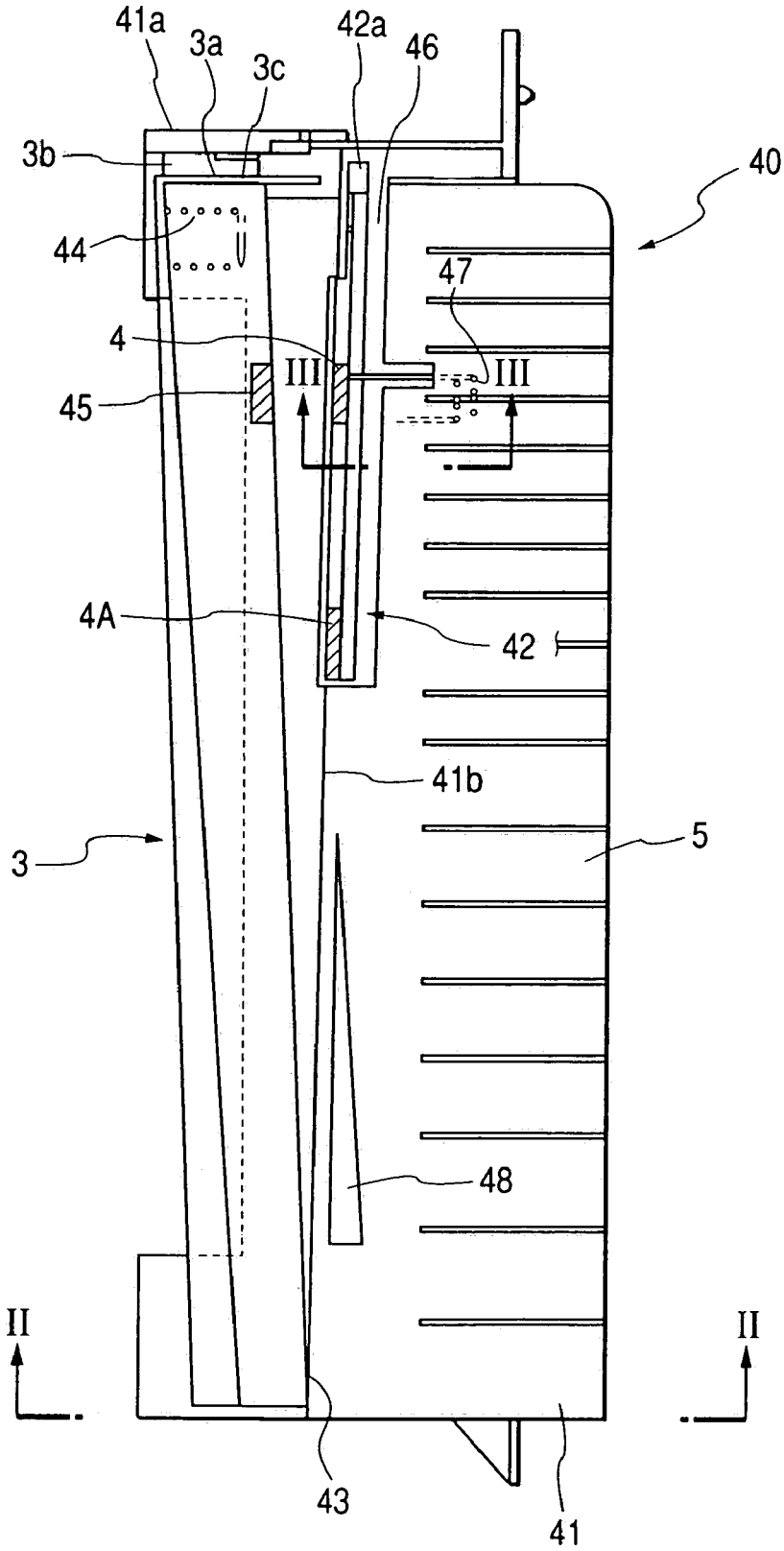
FIG. 4 is a plan view of a second unit.
Figure 5:
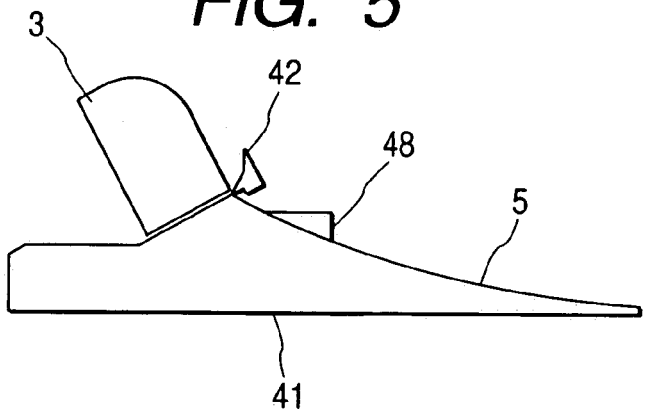
FIG. 5 is a side view of II—II arrow view in FIG. 4.

In the second unit 40, as shown in FIGS. 4 and 5, a front inclined face of the frame 41 extending in the width direction of the recording apparatus 1 is used as the paper guide 5 and the hopper 3 is placed on a rear inclined face of the frame 41. On the top of the frame 41, the paper returner 42 is placed along a ridgeline portion 41*b*, and a base end of the paper returner 42 is placed in the ridgeline portion 41*b* for rotation. One end of the hopper 3 in the width direction of the recording apparatus 1 is attached along the inclined face of the frame 41 so as to be rotatable about a support point 43, and an opposite end is positioned on the side of the first unit 30 and a hopper edge guide 3*a* is provided. The upper end face thereof forms a hopper cam follower 3*c* on which the hopper driving cam 34 is abutted. A projection 3*b* extending from the hopper edge guide 3*a* to the outside is inserted into a hopper guide 41*a* placed upright from the frame 41 for regulating motion of the opposite end of the hopper 3 so that it is moved only up or down.

The rotation support point 43 of the hopper 3 is placed so that the hopper face in the proximity of the rotation support point 43 almost matches the ridgeline portion 41*b*, for preventing the paper tip from being caught in the frame 41 on the rotation support point 43 side of the hopper 3, when paper is set. A hopper spring 44 is placed between the hopper 3 and the frame 41 on the rear in the, proximity of the opposite end of the hopper 3 for urging the hopper 3 in the crest direction of the inclined face. A sheet 45 having a friction coefficient higher than that of other hopper face is put on the hopper 3 so as to match with the position of the separation pad 4.

Figure 7:
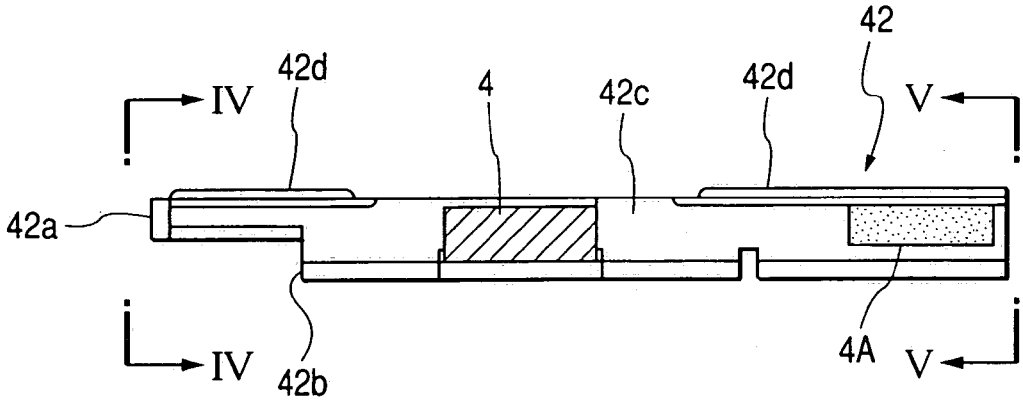
FIG. 7 is a plan view of the paper returner.
Figure 8:
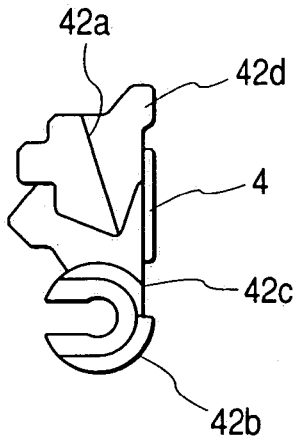
FIG. 8 is a side view of IV—IV arrow view in FIG. 7.
Figure 9:
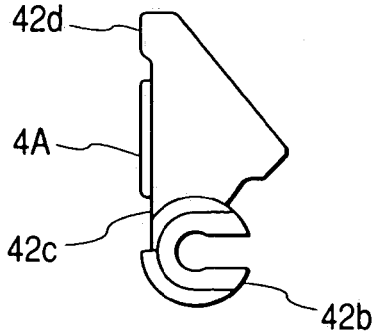
FIG. 9 is a side view of V—V arrow view in FIG. 7.

As shown in FIGS. 7 to 9, a base end 42*b* formed as a bearing structure is fitted with a shaft part of the frame 41 so as to make the paper returner 42 rotatable. The separation pad 4 and the auxiliary pad 4A which are placed away from each other are provided on a surface 42*c* of the paper returner 42. A cam follower 42*a* for initially inclining the paper returner 42 is placed on the edge guide 3*a* side of the hopper 3 and the subsidiary cam 36 placed on the side of the hopper driving cam 34 acts on the cam follower 42*a*. The subsidiary cam 36 and the cam follower 42*a* constitute an initial incliner which starts to rotate the paper returner 42 at a predetermined angle from the stand-up position to the fall-down position in association with rotation of the paper feeding roller 2 in a paper feed direction.

At a free end on an opposite side to the base end 42*b*, a protrusion 42*d* is formed on the surface 42*c* in a portion except the separation pad 4 is provided. The protrusion 24*d* acts so as to reliably grasp the leading end of sheet, and return it to the hopper 3 when the paper returning operation is performed as described later.

Figure 6A:
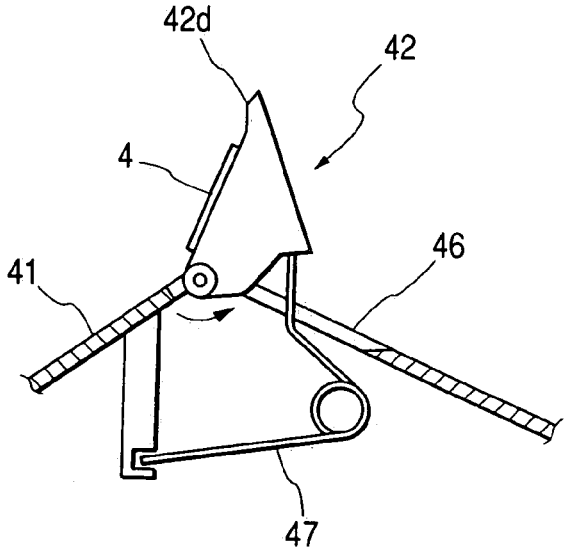
FIGS. 6A and 6B are schematic representations to show operation of a paper returner in sectional view taken on line III—III in FIG. 4.
Figure 6B:
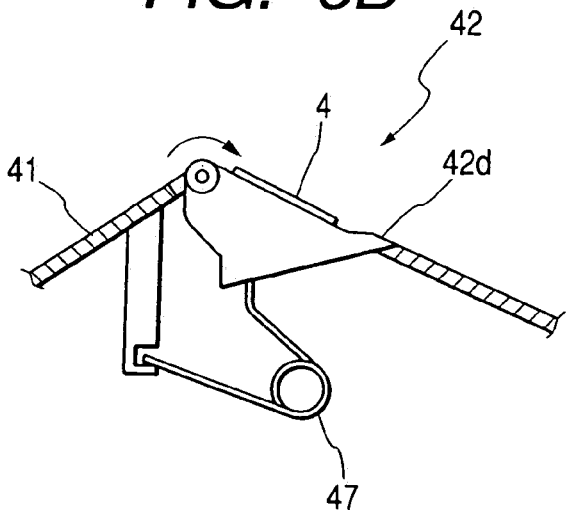

The paper guide 5 is formed with a notch part 46 of roughly the same shape as the paper returner 42. The notch part 46 is covered when the paper returner 42 rotates against the urging force of a paper returner spring 47 from the stand-up position shown in FIG. 6A to the fall-down position shown in FIG. 6B. The notch part 46 is flush with the paper guide 5. The paper returner spring 47 is implanted as a coil spring, for example, and is disposed on the rear slope of the frame 41. The paper returner spring 47 is retained at one end on the back of the paper returner 42 and at an opposite end on the frame 41 for urging the paper returner 42 so as to stand up the paper returner 42 as shown in FIG. 6A.

The paper returner 42 stands up almost vertically for blocking accidental entry of paper into the paper transporting passage when paper is set. In the stand-up state, the paper returner 42 is out of the rotation path of a roller face of the paper feeding roller 2 and a rotation force cannot be given. Then, to enter a portion for making the rotation force act on the paper returner 42 in the rotation path of the roller face of the paper feeding roller 2, the paper returner 42 is initially rotated at a predetermined angle in association with rotation of the paper feeding roller 2 by the subsidiary cam 36 and the cam follower 42*a* (the initial incliner) at the initial stage of rotation of the paper feeding roller 2 for feeding paper. Then, the force from the paper feeding roller 2 acts directly on the paper returner 42 for rotating the same. Accordingly, the paper returner 42 can be rotated smoothly.

On side of the hopper 3 close to the rotation support point 43, a paper receptor 48 is formed on the paper guide 5 near to the ridgeline portion 41*b* and has a triangular plane which is wide on the rotation support point 43 side of the hopper 3 and becomes narrower toward the center, whereby a load shift of stacked sheets of paper is prevented.

Figure 11:
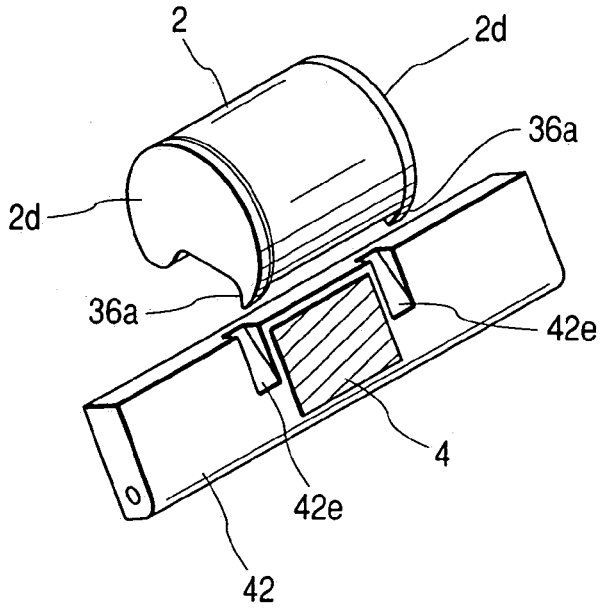
FIG. 11 is a perspective view to show another embodiment of inclination means for performing initial rotation when a paper returner is fallen down.

FIG. 11 is a perspective view to show another embodiment of the initial incliner for performing the initial rotation to fall down a paper returner. A separation pad 4 is formed on both sides with a groove cam 42*e* toward a free end of a paper returner 42. A subsidiary cam 36*a* acting on the groove cam 42*e* of the paper returner 42 is placed on each of flanges 2*d* on both sides of a paper feeding roller 2. Before a roller face of the paper feeding roller 2 comes in contact with the separation pad 4 of the paper returner 42, the subsidiary cams 36*a* act on the groove cams 42*e* for initially rotating the paper returner 42 at a predetermined angle. The subsequent falling-down operation of the paper returner 42 is the same as that in the above-described embodiment.

Figure 12:
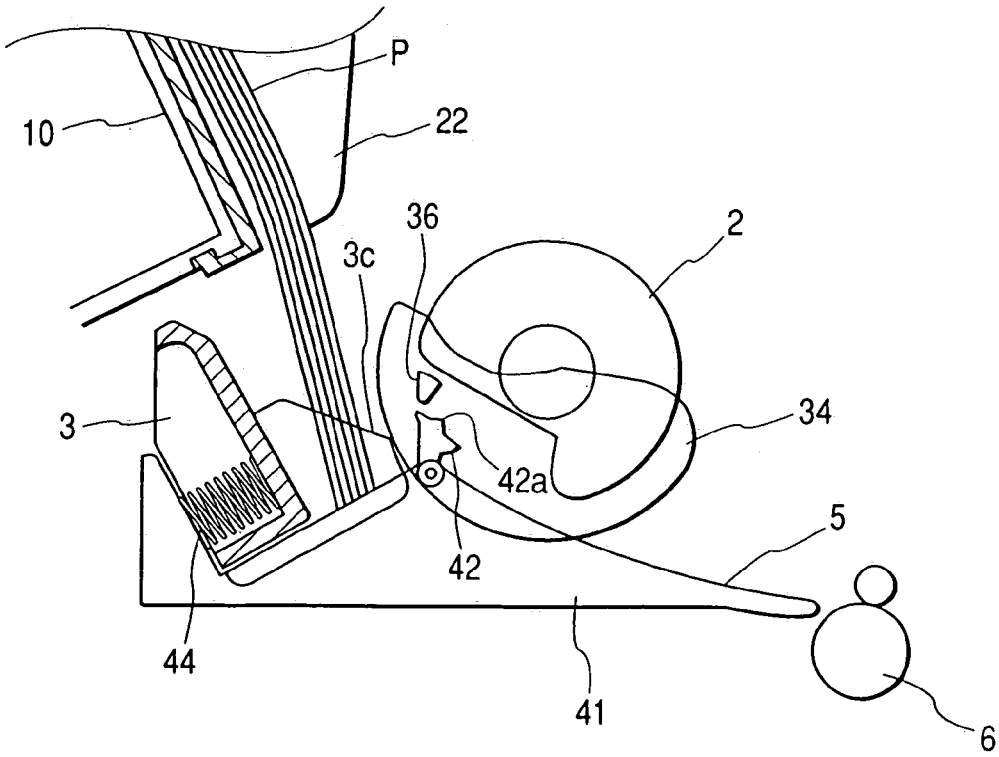
FIG. 12 is a drawing to show the relationship between the hopper and the paper returner when a paper feeding roller is at a home position.

Next, the paper feed operation will be explained in detail. FIGS. 12 to 24 are schematic representations to show a flow of the paper feed operation. A plurality of sheets of paper P are set in a paper support 21. A flat portion 2*c* of the paper feeding roller 2 at the home position is almost parallel to a face of the paper guide 5 of the frame 41. The paper returner 42 stands up and does not interfere with the paper feeding roller 2. In this state, it is blocked accidental entrance of the leading end of the set paper into the transport passage between the paper feeding roller 2 and the hopper 3. On the other hand, the hopper 3 is pressed down to the lowermost position by a hopper driving cam 34 (state in FIG. 12).

Figure 13:
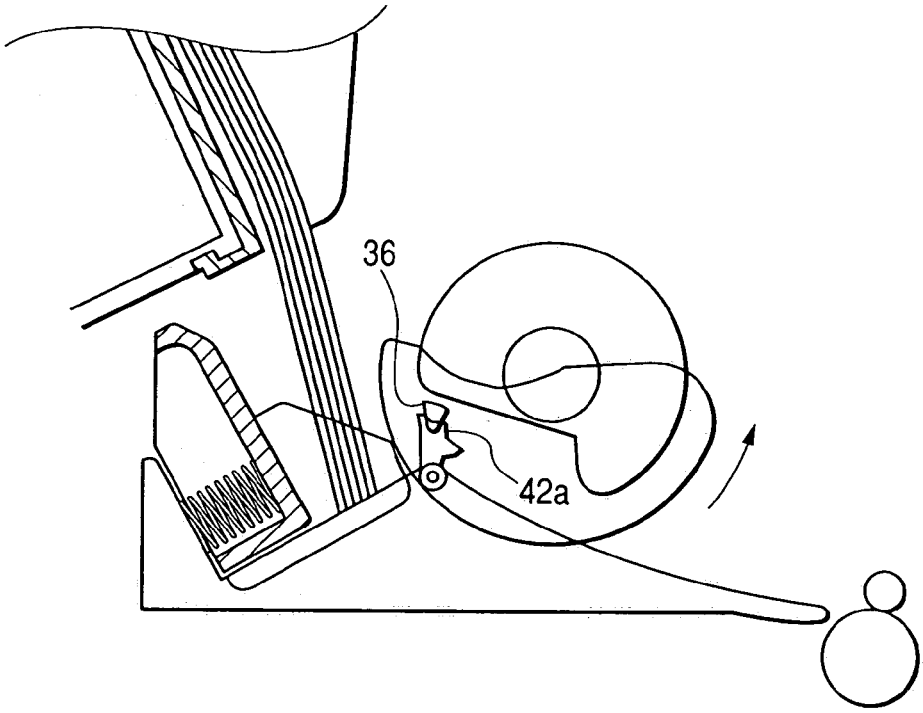
FIG. 13 is a drawing to show staring to fall down the paper returner by a subsidiary cam.
Figure 14:
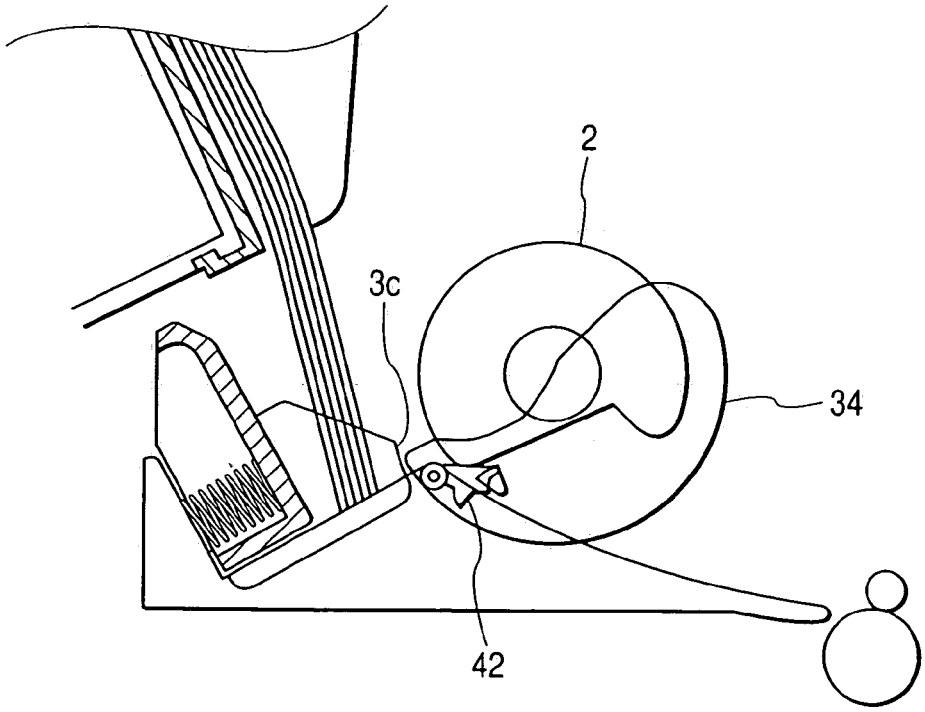
FIG. 14 is a drawing to show a state in which the paper feeding roller abuts a separation pad.
Figure 15:
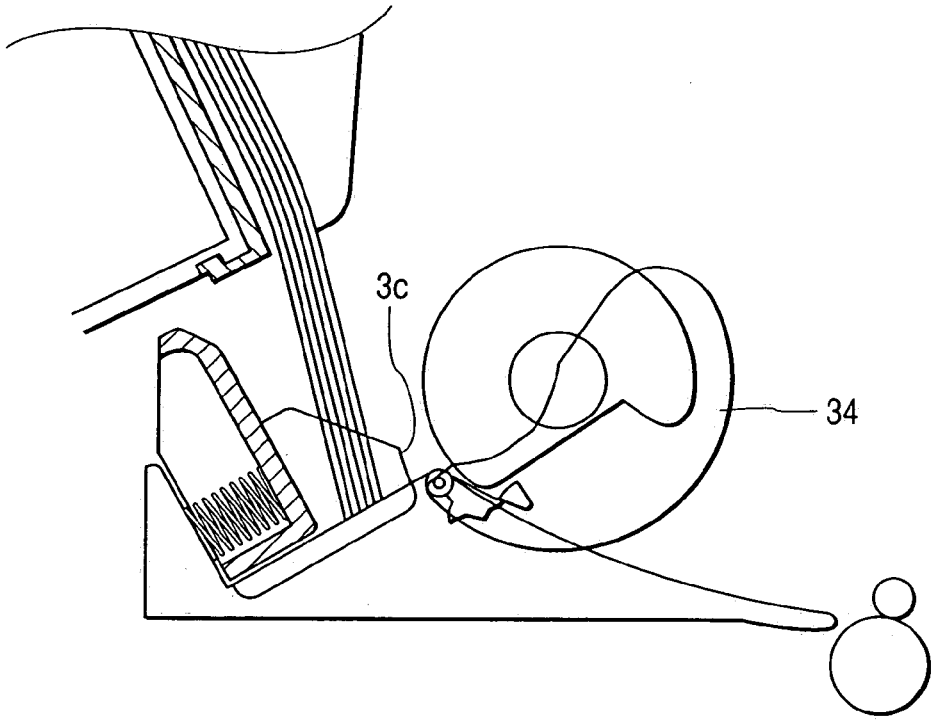
FIG. 15 is a drawing to show a fall-down position of the paper returner.

When the paper feeding roller 2 rotates as paper feed starts, the subsidiary cam 36 first acts on the cam follower 42*a* of the paper returner 42 so that the paper returner 42 is slightly inclined as the initial operation of falling down (state in FIG. 13).

After the paper returner 42 is inclined at a predetermined angle, the paper feeding roller 2 abuts the surface of the paper returner 42 and rotates the paper returner 42 toward the fall-down position by the rotation press force against the urging force of the paper returner spring 47. Meanwhile, the hopper driving cam 34 acts on the hopper cam follower 3*c* for maintaining the hopper 3 at the lowermost position (state in FIG. 14).

Figure 16:
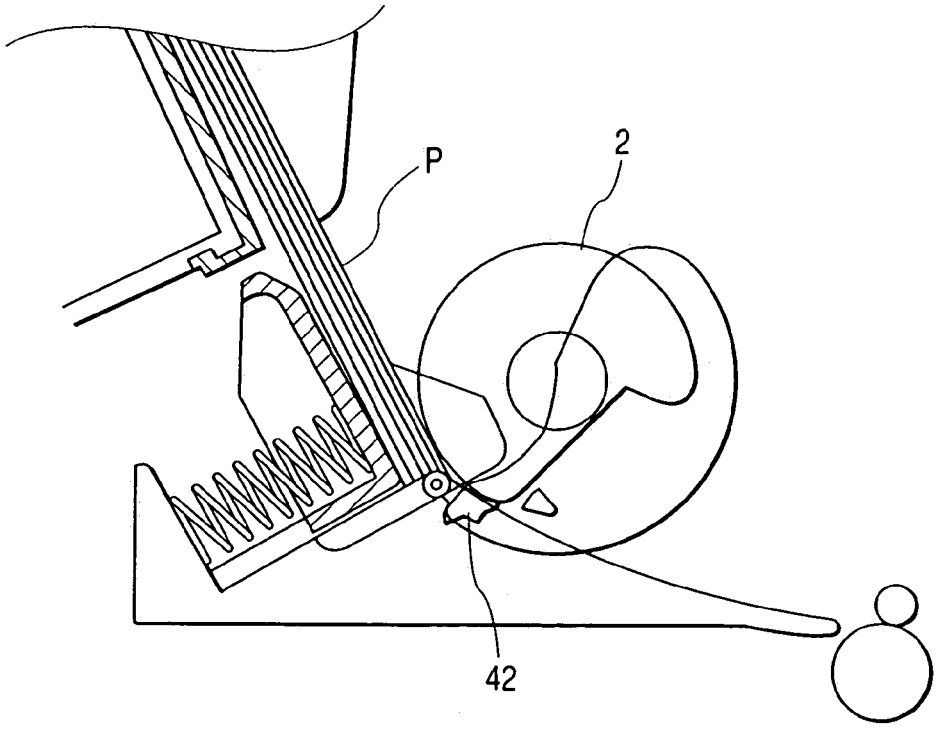
FIG. 16 is a drawing to show a state just after the hopper moves up.

The paper returner 42 reaches the fall-down position (state in FIG. 15) and then maintaining the hopper 3 at the lowermost position by the hopper driving cam 34 is released and the hopper 3 is moved up by the hopper spring 44 for pressing the top sheet of paper against the paper feeding roller 2 (state in FIG. 16).

Figure 17:
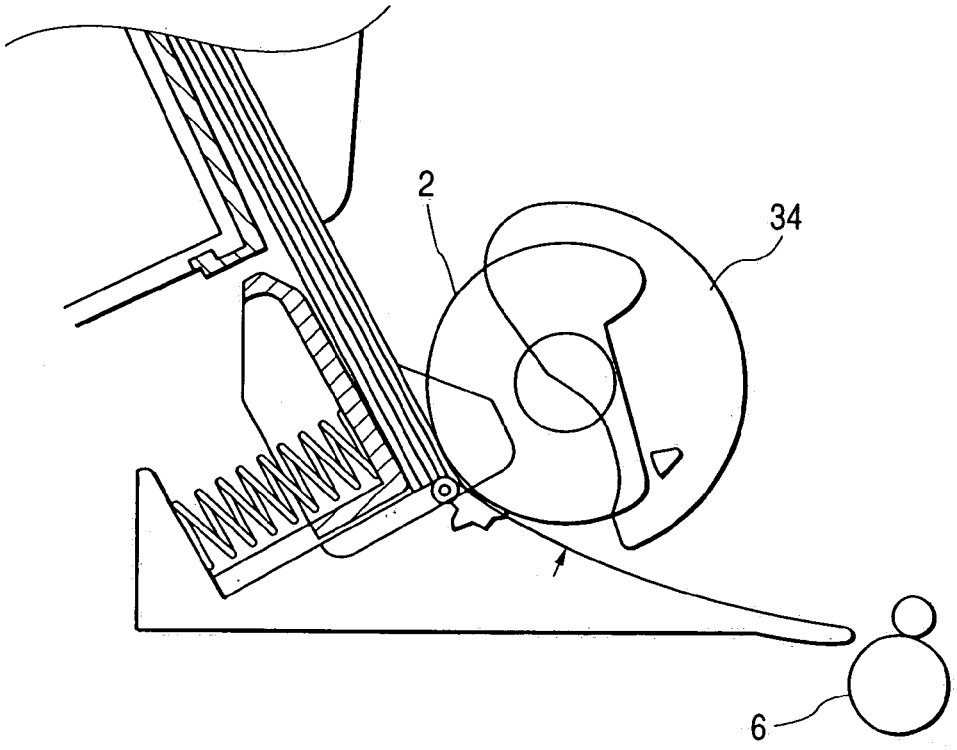
FIG. 17 is a drawing to show a state in which paper is being fed.
Figure 18:
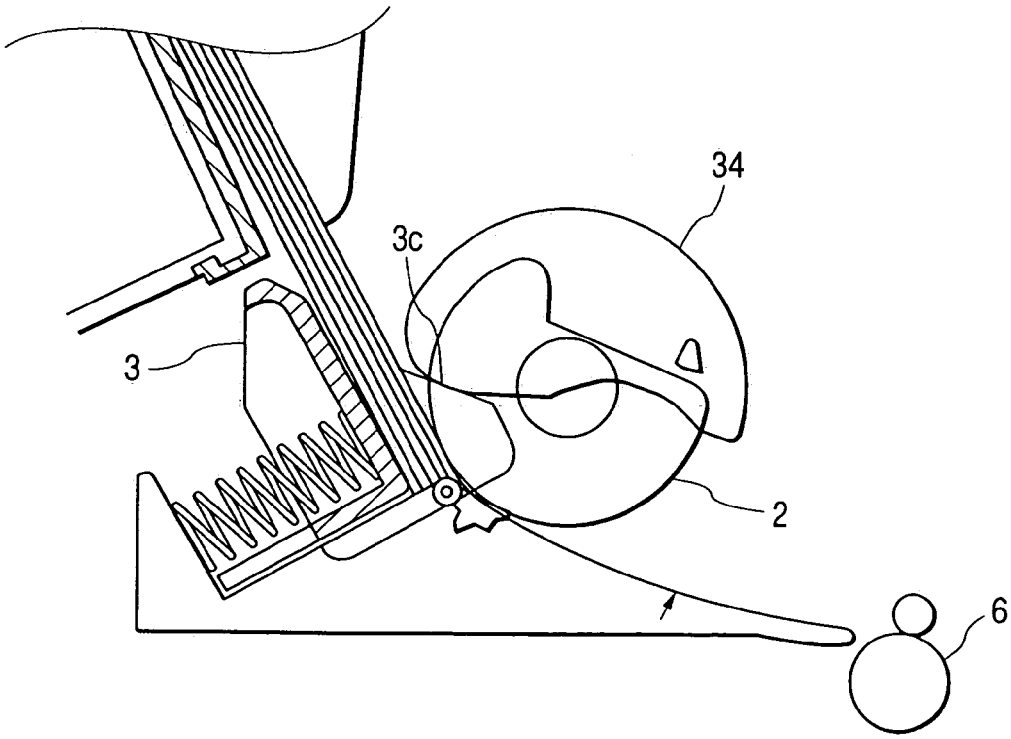
FIG. 18 is a drawing to show a state just before the hopper starts to move down.
Figure 19:
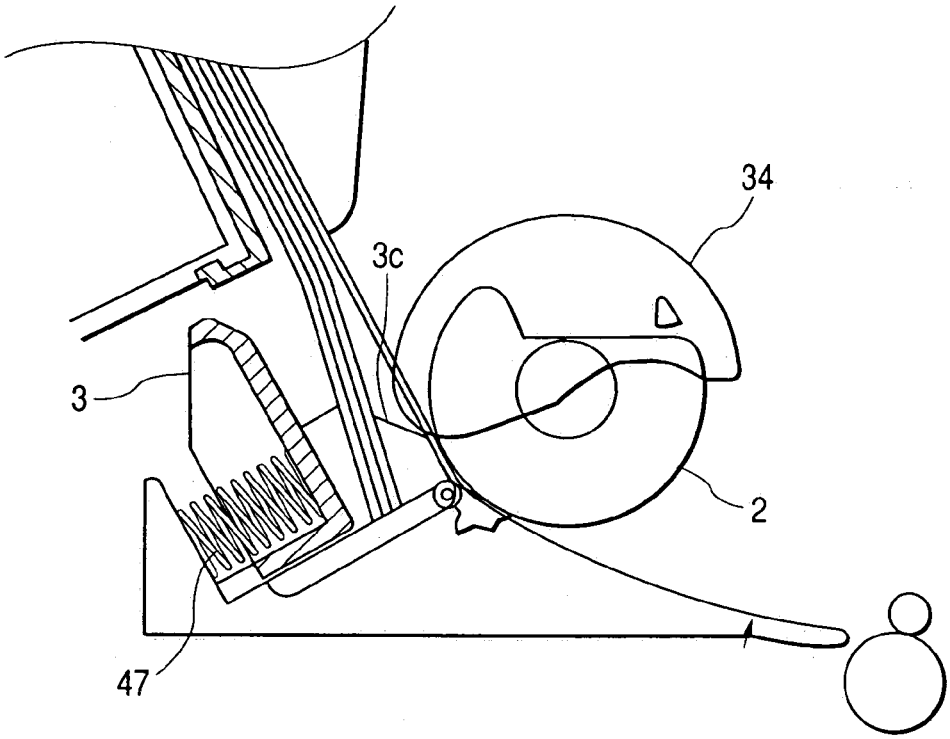
FIG. 19 is a drawing to show a state in which the hopper is moving down.
Figure 20:
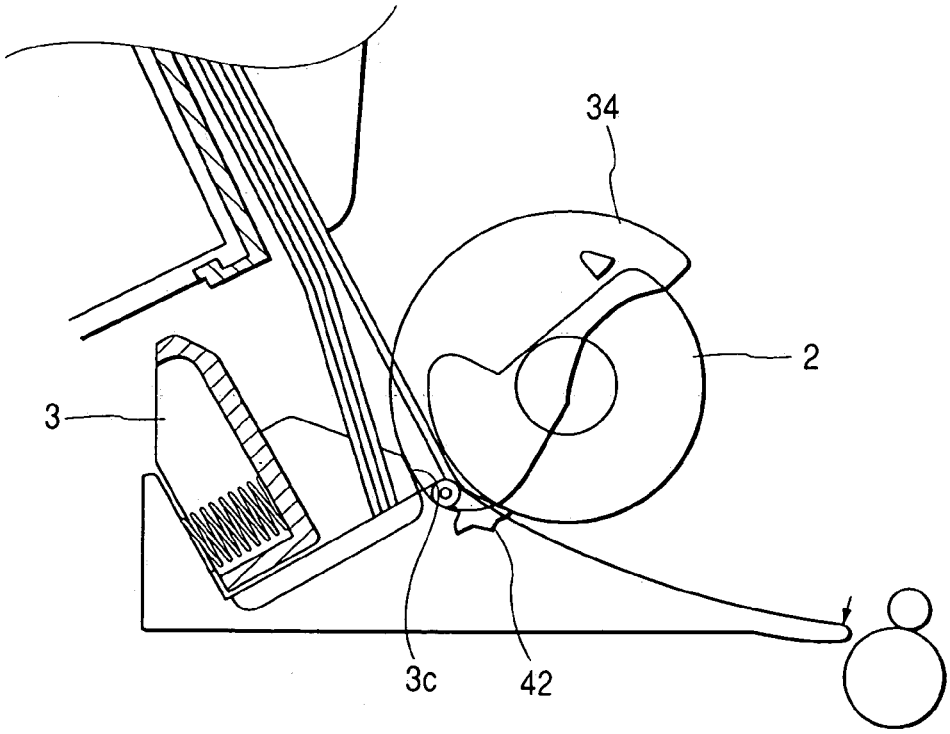
FIG. 20 is a drawing to show a state in which the hopper arrives at the lower limit.

As the paper feeding roller 2 rotates, feeding the top sheet starts (state in FIG. 17). In the following figures, the upper arrow indicates the position of the leading end of the fed sheet. Before the leading end of the fed sheet arrives at the transport roller 6, the hopper driving cam 34 acts on the cam follower 3*c* for starting to move down the hopper 3 at the position just before move down shown in FIG. 18. FIG. 19 shows a state in which the hopper 3 is moving down.

Figure 21:
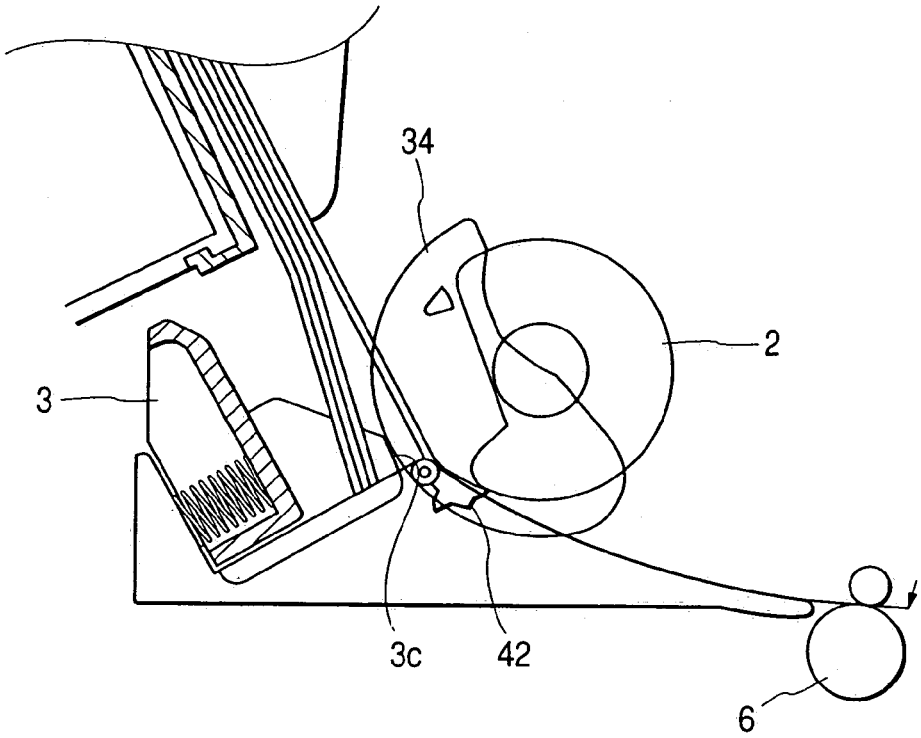
FIG. 21 is a drawing to show a state just before the paper returner starts the stand-up operation.

The hopper 3 arrives at the lowermost position (FIG. 20) and then the standing-up operation of the paper returner 42 is started by the spring force of the paper returner spring 47. FIG. 21 shows a state just before the paper returner 42 is stood up. Meanwhile, the leading end of the fed sheet arrives at the transport roller 6 so that the skew removal and the positioning operation are performed.

Figure 22:
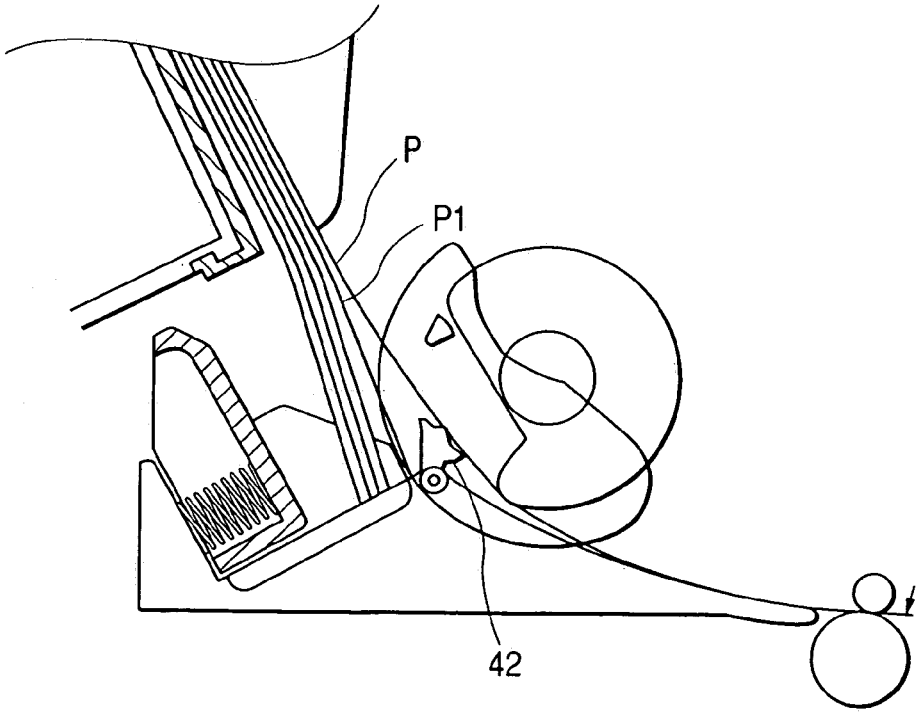
FIG. 22 is a drawing to show a state in which the paper returner arrives at a stand-up position and paper return is completed.
Figure 23:
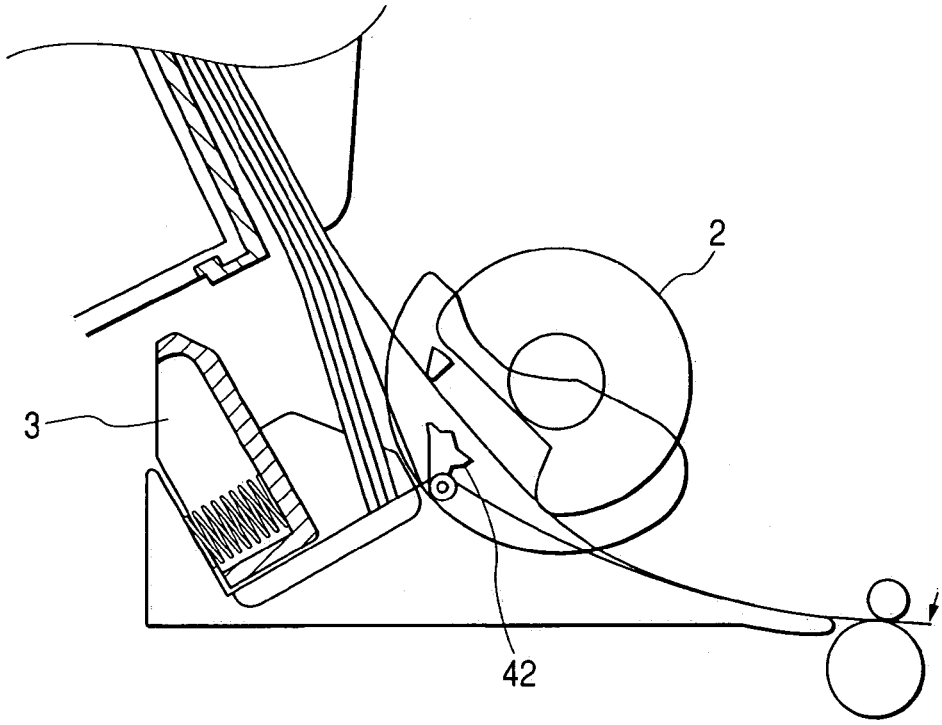
FIG. 23 is a drawing to show rotation of the paper feeding roller after the paper return is completed.
Figure 24:
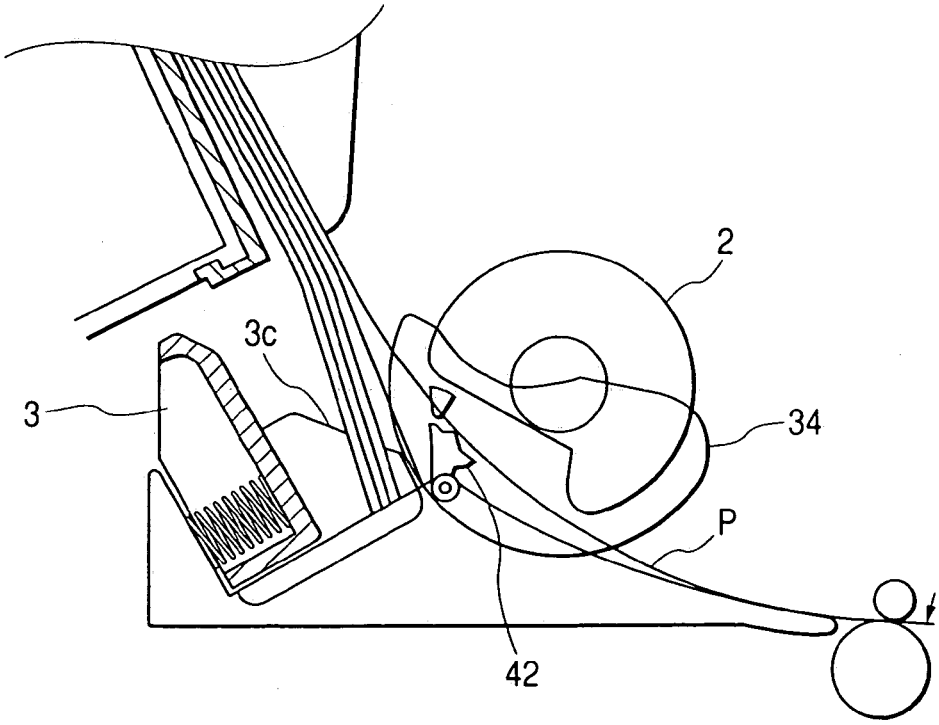
FIG. 24 is a drawing to show a state in which the paper feeding roller is returned to the home position.

Subsequently, standing up the paper returner 42 is completed by the spring force of the paper returner spring 47. During the rotating for standing up the paper returner 42, a leading end of a sheet P1 overlappedly transported with the top sheet P and entered between the paper feeding roller 2 and the paper returner 42 by a wedge effect in the previous operation is grasped, and the sheet P1 is pushed back into the hopper 3. FIG. 22 shows a state at the paper returning operation is completed. FIG. 23 shows a state in which the paper feeding roller 2 is rotating to the home position after completion of the paper returning operation. While the paper feeding roller 2 is returned to the home position, print on the paper P is started (state in FIG. 24).

According to the invention, the separation pad is attached to the paper returner, so that the number of parts can be decreased and the structure can be simplified for reducing costs as compared with the case where the separation pad holder and the paper return lever are provided separately as in the related paper feeder.

When paper is not fed, the paper returner is stood up, whereby accidental entry of paper into the paper transporting passage can be blocked.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A paper feeder, for feeding a sheet of paper to a recording apparatus, comprising:

a hopper, for stacking a plurality of sheets of paper;

a paper feeding roller, adapted to feed the sheets of paper one by one in a first direction;

a guide plate disposed adjacent to the hopper relative to the first direction to form a part of the paper transporting passage, and opposing to the paper feeding roller;

a paper returner having a first face and pivotable between a first position at which the first face is made flush with the guide plate, and a second position at which the first face blocks the paper transporting passage; and a separation pad, provided on the first face of the paper returner and having a friction coefficient which is higher than a friction coefficient of the first face of the paper returner.

2. The paper feeder as set forth in claim 1, wherein the first face of the paper returner prevents the sheets of paper in the hopper from entering the paper transporting passage, when the paper returner is placed in the second position.

3. The paper feeder as set forth in claim 1, wherein the paper feeding roller is arranged, such that it contacts only on one side of one surface of the widthwise direction of the sheet of paper.

4. The paper feeder as set forth in claim 1, wherein the paper returner further comprises a distal end having a protrusion formed thereon.

5. The paper feeder as set forth in claim 1, further comprising an auxiliary roller operative to feed the sheets of paper together with the paper feeding roller, wherein:

the paper feeding roller and the auxiliary roller are arranged in a second direction perpendicular to the first direction, and the paper returner is elongated in the second direction so as to oppose to both of the paper transporting roller and the auxiliary roller.

6. The paper feeder as set forth in claim 5, wherein the separation pad includes a first pad opposed to the paper feeding roller and a second pad opposed to the auxiliary roller.

7. The paper feeder as set forth in claim 1, wherein the separation pad extends parallel with the guide plate when the paper returner is placed in the first position.

* * * * *